United States Patent [19]

Stephenson

[11] 4,186,951

[45] Feb. 5, 1980

[54] MACRAME LOOM

[76] Inventor: Richard Stephenson, 34450 Dequindre, Sterling Heights, Mich. 48077

[21] Appl. No.: 845,578

[22] Filed: Oct. 26, 1977

[51] Int. Cl.[2] ..... D03J 3/00

[52] U.S. Cl. ..... 289/16.5; 248/125

[58] Field of Search ..... 289/18, 18 M, 1.2, 1.5; 248/125, 511, 534, 535

[56] References Cited

U.S. PATENT DOCUMENTS

| | | | |
|---|---|---|---|
| 2,104,072 | 1/1938 | Carr | 248/125X |
| 2,155,097 | 4/1939 | Mendle | 248/125 |
| 2,584,310 | 2/1952 | Weinberg | 248/125 |
| 3,797,790 | 3/1974 | Iseki | 248/125 X |
| 4,029,347 | 6/1977 | Garcia | 289/18 M |

*Primary Examiner*—Louis Rimrodt

*Attorney, Agent, or Firm*—Gerald R. Hershberger

[57] ABSTRACT

My adjustable macrame working device is comprised of a wide base which is preferably self supported on the floor. I have provided an elongated substantially tall, upwardly standing, vertical post which is rigidly and integrally connected to the base. I further provide an elongated, cantilevered lever arm or beam which is adjustably connected substantially horizontal to the post. The end of the beam connected to the post is provided with a manually operable height adjusting means, including a lever action fulcrum portion which secures said beam slidably but non-detachably laterally and exerts frictional holding pressure on opposite sides of the post by gravitational force when the beam is hanging in horizontal position. Rapid selection of the height of the beam is obtained by lifting upwardly on the beam which releases the fulcrum pressure on the post allowing the beam to be slid freely upwardly and downwardly. When the desired location of the beam is reached the beam is lowered and the weight of the beam and the macrame again applies pressure on the post at the fulcrum point frictionally locking the beam in position for working the macrame in the new location.

1 Claim, 4 Drawing Figures

MACRAME LOOM

BACKGROUND OF THE INVENTION

1. Field of the Invention

This invention relates to hand looms and more particularly to a hand loom or device for making articles of macrame which may be conveniently adjusted upwardly as work on the macrame proceeds.

2. Description of the Prior Art

There are not any practicable devices known to the inventor which provide for convenient adjustment during the working of the macrame.

It is a characteristic of macrame weaving, that one works from the top downwardly, and as the work proceeds, the work must be raised at frequent intervals to accommodate the increased length of the product.

Therefore, it is evident that an improved macrame loom is needed to obviate the undesirable features of the prior art. The most pertinent devices revealed by a thorough patent search do not disclose looms that have a readily available height adjusting feature for quickly adjusting the height of the work as the weaving progresses. This invention eliminates the need of screw drivers or other tools to change the height of the loom while weaving, and saves valuable time and energy, as the operator may quickly and easily change the height of the macrame as the length of the work increases.

SUMMARY OF THE INVENTION

The present invention is a macrame loom or working device which encompasses construction which permits the macrame work product to be removably attached to a horizontal, cantilevered beam which is in turn movably attached to an elongated upright post rigidly mounted on a floor supported base. As the length of the macrame increases during weaving, my quick release clamping feature connecting the beam to the post allows the beam to be moved quickly and easily to a new height by simply lifting on the beam manually and moving it to the desired height. This feature allows the operator to sit in a chair comfortably while working as the work will always be held at the correct work height.

The cantilevered feature of my device permits ready access by the operator to the work product from all angles without the mechanical parts of the device interferring or hindering the operator while weaving the macrame product.

Therefore, it ia an object of my invention to provide a macrame loom having a quick height adjustment means for adjusting the height of the macrame product while weaving.

It is a further object of the present invention to provide a beam construction for holding the macrame outwardly for convenient work accessibility.

It is another object of my invention to provide a unique height adjusting means which combines the feature of a readily adjustable clamping means with the function of a support.

It is a further object of the present invention to provide an inexpensively manufactured loom with the features of adjustability and accessibility to the work product.

It another object of my invention to provide a macrame loom which is convenient to use and operate.

It another ofject of this invention to provide a macrame loom wherein the work product is supported automatically at a given height on a beam support by a combination of frictional and gravitational forces.

Accordingly, the objects and advantages of this invention will become apparent in the following description taken in conjunction with the accompanying drawing wherein like reference characters are used for indicating like components throughout the various views.

DRAWING

DESCRIPTION OF THE INVENTION

Figure 1:
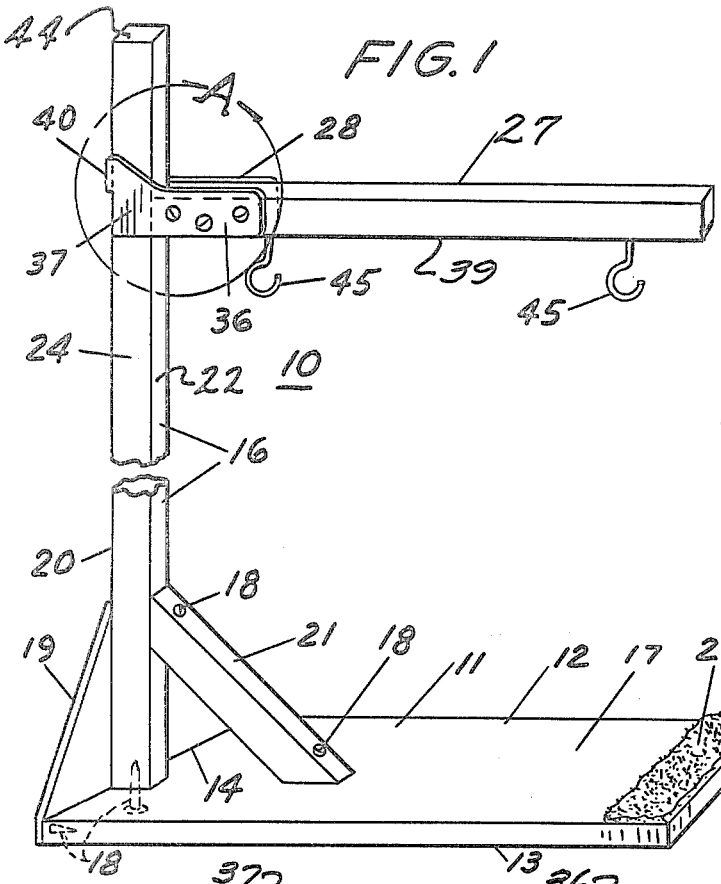
FIG. 1 is an elevational view of my macrame working device representing the preferred embodiment.
Figure 3:
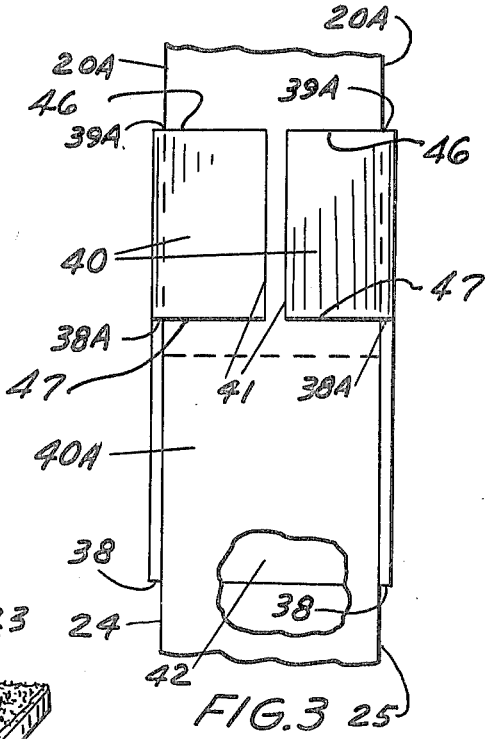
FIG. 3 is a front view of the adjusting means taken along lines 3—3 of FIG. 2.
Figure 4:
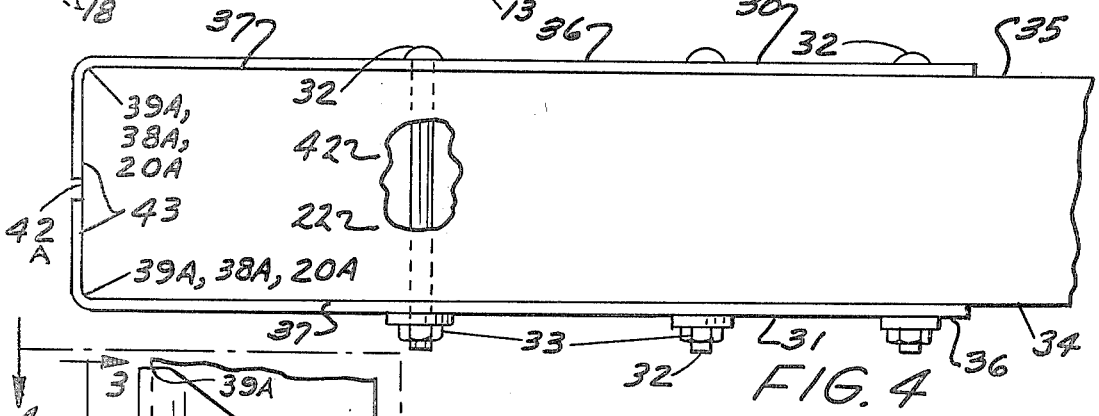
FIG. 4 is a plan view of the adjusting means taken along lines 4—4 of FIG. 2.
Figure 2:
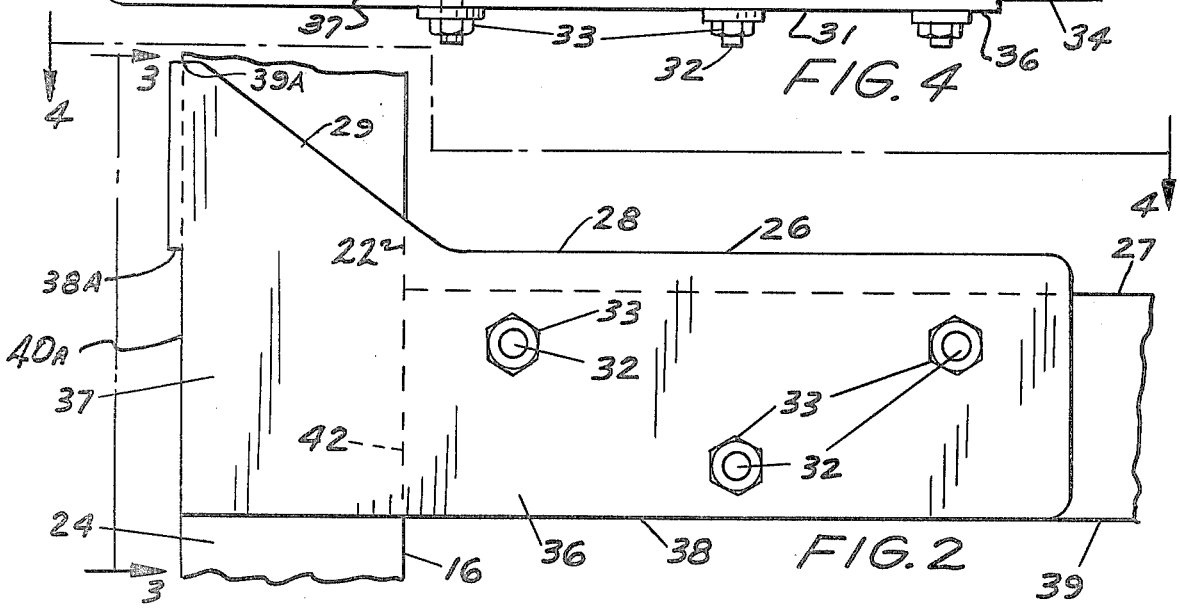
FIG. 2 is an enlarged view of the adjusting means taken within the circle "A"

Referring now to FIG. 1, there is illustrated the complete assembly of my device 10 which includes a base 11 made from a sturdy type of sheet material such as plywood or other similar material.

The base 11 is rectangularly outlined and the elongated sides 12 and 13 are approximately two feet long, and short sides 14 and 15 are approximately sixteen inches long. My macrame upright pillar or post 16 is mounted to the upper surface 17 of said base and securely and fixedly fastened adjacent the short side 14 by screws and dowels 18, or similar fastening means. An angularly outlined flat plate 19 is fastened flush to the rear side 20 of said post and edge or short side 14 to stabilize the post laterally with respect to the base 11, and a diagonal brace 21 is fixedly fastened to the upwardly or vertically to the front side 22 of said post and extended downwardly from such post to such top surface 17 rigidly to stabilize said post from fore and aft movement with respect to said base. A protective material such as indoor outdoor carpeting 23 is applied to to such top surface of said base.

The post member is of annular, elongated, generally rectangular cross sectional outline and has a rear, flat side 20, a front flat side 22 a left flat side 24 and a right generally flat side 25. Said post is preferrably constructed of wood and is approximately two inches by two inches square, and approximately seven feet high. The height however, may be varied and made even higher if the length of the work requires additional height.

My device further encompasses an elongated, cantilevered beam 27 of generally rectangular cross sectional outline like wise preferably made of sturdy wood. The size of the cross sectional area of the beam is substantially the same as the post or two inches by two inches square, but the length is approximately twenty two inches long.

The beam 27 is arranged and adapted to be held rigidly horizontally in work position by my quick or rapid height adjustment means 28 which attaches said beam movably to said post.

Said height adjusting means is comprised of a fulcrum portion 29 having a right hand clamping and holding piece 30 and a left hand clamping and holding piece 31. Said fulcrum pieces or members 30 and 31 are otherwise congruent and coterminious in outline. Such fulcrum pieces are preferrably constructed of heavy, rigid, flat sheet metal stock and each such piece includes an elongated generally rectangular beam attachment portion 36 which is rigidly attached adjacent the beam substantially flat post end 42 on opposite sides 34 and 35 of said beam straddling same, by screws 32 and nuts 33 extending through the beam.

The beam flat post end or face 42 contacts the front side 22 of said post flush and operates as a pressure pad for exerting pressure from said beam to the front post side or face 22 as will be more fully described infra.

Such fulcrum beam attachment portions are extended forwardly generally parallel to said beam sides to form beam guide portions 37 which lie closely to left and right of the sides 24 and 25 of said post because the beam and post are substantially of the same width. The bottom edge 38 of the beam attachment and guide portions of such fulcrum pieces is substantially straight and parallel to the bottom side 39 of said beam and is extended forwardly adjacent front side 20 of said post to provide a substantial guide portion bearing surface on the post sides. The top edge 26 of said pieces is likewise straight and parallel with the bottom edge or side 39 of the beam and bottom edge 38 of said pieces throughout the length of such beam attachment portions, however, such top edge is angled diagonally upwardly adjacent the front side of such post a distance of substantially three inches above edge 38 to break corners **39*a* which are coextensive with the edges 20*a* of said front side 20**.

The fulcrum guide flange portions 40 are then flanged inwardly around said post front side 20 at said break corners **39*a* and 38*a* to define a generally rectangularly outlined pressure pad gripping and guide closure portions 40 having top edges 46 and bottom edges 47. The ends 41 of said closure portions terminate adjacent or intermediate the center 42*a* of said post side 20. The flange portions 40 are purposely substantially shortened vertically and extend downwardly approximately one and one quarter inches from said upper corner 39*a* so that the flanges do not cover the open area post surface 40*a* directly opposite the post pad area surface 41*a* where the beam pressure pad face portion 42 contacts the post to allow room for tilting the beam upwardly to break the contact between the post and the beam pressure pad so that the beam can be moved. The inside face 43 of the flange pads and the inside beam pad face 42 are substantially parallel and are spaced apart a distance substantially equal to the width ofthe post between sides 20 and 22** so that when the beam is free to hang, or a load or force is applied in the direction of bottom end of the post, the pressure pads, being offset, augment the pressure of the weight of the beam and/or macrame on the post due to the mechanical advantage or leverage obtained because the beam is substantially longer than the relatively shorter vertical distance between pressure pads, in this instance the ratio of beam to pressure pad offset is approximately seven to one depending where the load is placed on the beam.

The vertical displacement of the pads also provide additional stability to the beam since the spacing between the pads is greater than the height of the beam and the pads are pressed tightly together flush against the sides of the post at all times when the load is on the beam.

In operation, the adjusting means fulcrum pieces are slid over the top end 44 of the post and moved downwardly to the desired height. When the height is reached the beam is left to hang, and the pads grip opposite sides of said post holding said beam securely in place. The macrame material is placed on supporting means or hooks 45 mounted at intervals on the underside 39 of the beam in preparation for weaving. When the weaving has progressed to the point that the work is lower than is convenient, for working, the beam is lifted relieving the weight thereon and slid easily and freely on the post to a convenient height for further weaving. This procedure is repeated until the work is completed.

Although the invention has been described in its preferred forms, it is understood that various modifications and changes in the details shown and discussed may be made without departing from the principles thereof and within the scope of the invention as determined by the following claims.

What is claimed is:

1. In a loom for working macrame having an adjustable beam support means for an elongated substantially parallel sided beam of generally square cross-section horizontally supported on a vertically arranged, substantially parallel sided post of generally square cross-section, said beam having a butt end with a cross-section substantially identical to that of said post;

the improvement in the beam adjustment means comprising; a pair of cantilevered, mirror image, one-piece, sheet metal, fulcrum members disposed on opposite vertical sides of said beam end, each piece having a generally flat guide extension portion having substantially parallel and horizontally disposed top and bottom edges extending in the direction of the beam end axis, each of said beam end extension portions having an inner plane surface aligned with outer vertical plane surface of said beam defining a space gap therebetween approximating the width of one side of the generally square sectioned post, each of said fulcrum members having a guide length portion extending from the guide extension portions beyond the beam end straddling the post and terminating substantially adjacent the rear face of said post defining a slipfit recess for receiving said post therebetween, the rearward extremity of said beam guide length portion having diagonal edges extending rearwardly and upwardly from said guide extension top edges from a point adjacent the front of said post to break corners located congruent with the rear edges of said post;

said guide length portions having tab members inwardly bent at said break corners horizontally at substantially 90 degrees to the planar sides of the guide portions around the rear face of said post towards the center thereof to define generally congruent rectangular pressure flange pads positioned upwardly from said beam and having their inner edges terminating short of the center of said post to define a substantially small clearance gap therebetween to prevent said edges from overlapping each other, and inner flange planar surfaces abutting flush against the front side of said post at a point locating the inner flange surfaces in spaced relation to the beam at a distance approximating the width of the post between said beam end and said post rear face with the top break corners and edges of said flanges disposed in a horizontal plane substantially three inches above the horizontal plane of the upper surface of said beam, said upper edges and corners of said tab flanges being disposed a substantial distance above the lower edges and flanges of said tabs to define a substantial pressure area for engagment with the front side of said post;

and means clamping said fulcrum guide extension portions rigidly and fixedly to the sides of said beam to secure said tab flanges in cantilevered relationship to said beam end and post.

* * * * *